US009987863B2

(12) United States Patent
Sanada

(10) Patent No.: US 9,987,863 B2
(45) Date of Patent: Jun. 5, 2018

(54) PRINTER

(71) Applicant: TOSHIBA TEC KABUSHIKI KAISHA, Tokyo (JP)

(72) Inventor: Tsuyoshi Sanada, Susono Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/602,389

(22) Filed: May 23, 2017

(65) Prior Publication Data

US 2017/0348989 A1 Dec. 7, 2017

(30) Foreign Application Priority Data

Jun. 7, 2016 (JP) ..... 2016-113510

(51) Int. Cl.

| | |
|---|---|
| ***B41J 15/04*** | (2006.01) |
| ***B65H 26/08*** | (2006.01) |
| ***B65H 16/08*** | (2006.01) |
| ***B41J 11/00*** | (2006.01) |
| ***B41J 11/70*** | (2006.01) |
| ***B65H 16/02*** | (2006.01) |

(52) U.S. Cl.

CPC ..... *B41J 15/048* (2013.01); *B41J 11/0075* (2013.01); *B41J 11/70* (2013.01); *B41J 15/042* (2013.01); *B65H 16/028* (2013.01); *B65H 16/08* (2013.01); *B65H 26/08* (2013.01); *B65H 2301/41374* (2013.01); *B65H 2511/114* (2013.01); *B65H 2511/142* (2013.01); *B65H 2801/12* (2013.01)

(58) Field of Classification Search

CPC .... B41J 11/0075; B41J 11/0095; B41J 15/04; B41J 15/042; B65H 26/08

See application file for complete search history.

(56) References Cited

U.S. PATENT DOCUMENTS 5,713,678 A * 2/1998 Smith ..... B41J 11/64 226/45

7,549,814 B1 * 6/2009 Arrington ..... B65H 26/08 242/595.1

FOREIGN PATENT DOCUMENTS

JP 2003-252504 9/2003

OTHER PUBLICATIONS

Computer-generated translation of JP 2003-252504, published on Sep. 2003.*

* cited by examiner

*Primary Examiner* — Huan Tran

(74) *Attorney, Agent, or Firm* — Patterson & Sheridan, LLP

(57) ABSTRACT

According to an embodiment, a printer includes a drop portion that catches, in a case where a diameter of a roll of paper stored in a holder becomes small, the roll of paper that falls from the holder. The printer further includes a plurality of support rollers that are arranged so as to sandwich an inlet of the drop portion and rotatably support the roll of paper PR stored in the holder. At least one of the plurality of support rollers is a short-width roller whose width in an axial direction of a shaft is shorter than a paper width of the roll of paper PR, and a void is provided at a non-shaft arrangement part provided at an extension portion of the short-width roller in the axial direction.

11 Claims, 17 Drawing Sheets

PRINTER

CROSS-REFERENCE TO RELATED APPLICATION

This application is based upon and claims the benefit of priority from the prior Japanese Patent Application No. 2016-113510, filed on Jun. 7, 2016, the entire contents of which are incorporated herein by reference.

FIELD

Embodiments described herein are generally related to a printer.

BACKGROUND

A product information processing apparatus (e.g., POS terminal) normally includes a printer for issuing receipts. The printer mounted on the product information processing apparatus generally prints information on transaction details and the like on paper taken out from a roll of paper. Therefore, many printers include a holder for storing the roll of paper.

A diameter of the roll of paper gradually becomes small with use. In some cases, the printer includes a drop portion at a bottom portion of the holder for notifying a user that a time to exchange the roll of paper has come. The drop portion is a portion where the roll of paper falls and fits into when the diameter of the roll of paper becomes small. A sensor for detecting the roll of paper is provided in the drop portion. As the sensor detects the roll of paper, the printer notifies the user that the time to exchange the roll of paper has come.

For reducing a loss of a remaining amount of the roll of paper, it is desirable to make a width of the drop portion in a diameter direction as small as possible so that the roll of paper is not fit into the drop portion while there is still a large amount of paper left. Further, it is desirable to set the drop portion deep so that the roll of paper is not erroneously detected by the sensor. In this case, however, since the roll of paper is deeply and stably fit into the drop portion, it becomes difficult for the user to take out the roll of paper from the drop portion when replacing the roll of paper.

DETAILED DESCRIPTION

According to one embodiment, a printer prints on paper taken out from a roll of paper. The printer includes a holder, a drop portion, and a plurality of support rollers.

The holder stores the roll of paper.

The drop portion is positioned at a bottom portion of the holder and catches, in a case where a diameter of the roll of paper stored in the holder becomes smaller than a preset diameter, the roll of paper that falls from the holder.

The plurality of support rollers each include a shaft and rotatably support the roll of paper stored in the holder. The plurality of support rollers are arranged so that the rollers sandwich an inlet of the drop portion in a state where at least one of the plurality of support rollers is positioned on a roll-of-paper rotation direction side of the inlet and at least another one of the plurality of support rollers is positioned on a side opposite to the roll-of-paper rotation direction of the inlet. At least one of the plurality of support rollers is a short-width roller whose width in an axial direction of the shaft is shorter than a paper width of the roll of paper, and a void is provided in a non-shaft arrangement part provided at an extension portion of the short-width roller in the axial direction of the shaft.

Hereinafter, embodiments will be described with reference to the drawings. It should be noted that in the figures, the same or equivalent parts are denoted by the same symbols.

First Embodiment

Figure 1:
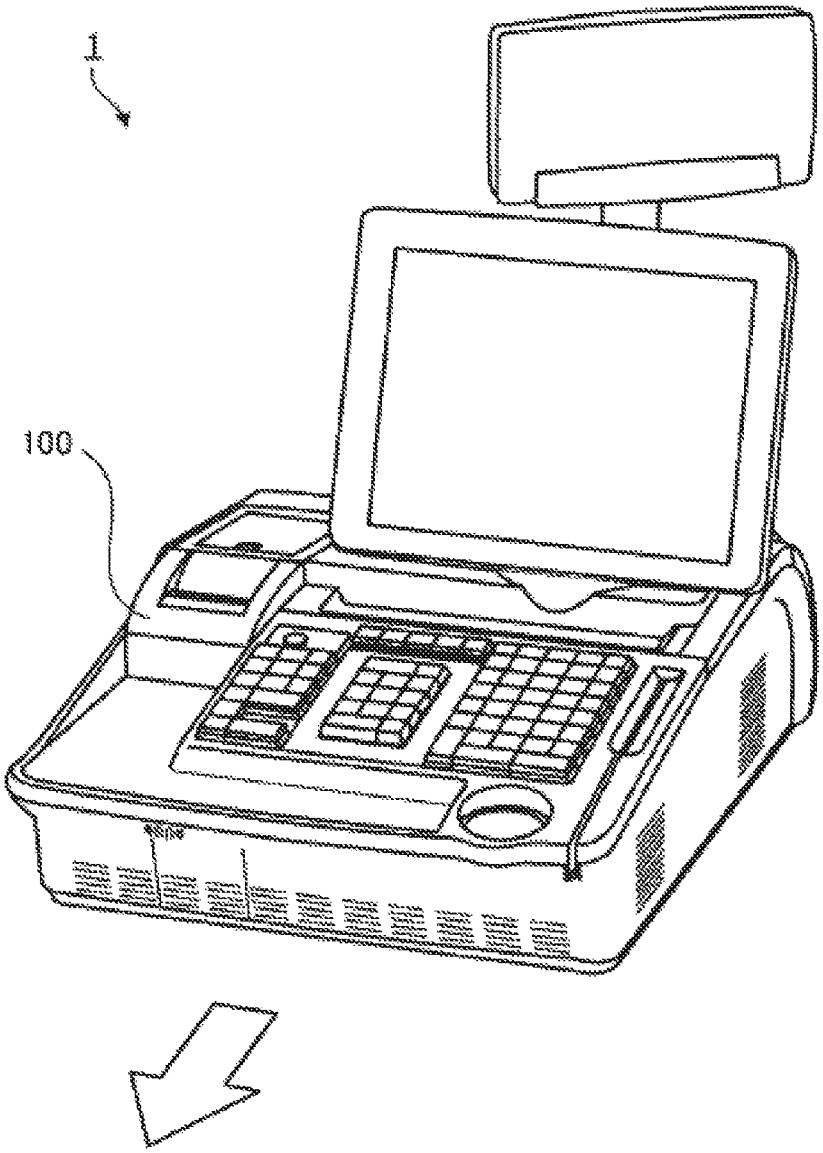
FIG. 1 is a perspective view of a product information processing apparatus including a printer according to an embodiment.

FIG. 1 is a perspective view of a product information processing apparatus 1 including a printer 100 according to a first embodiment. The product information processing apparatus 1 is, for example, a POS (Point of Sales) terminal. The product information processing apparatus 1 is installed in stores and operated by operators. The product information processing apparatus 1 is connected to a store server (POS server) (not shown) via a network.

The printer 100 is fixed to or incorporated into the product information processing apparatus 1. Looking at the product information processing apparatus 1 from the front, the printer 100 is arranged more on a left-hand side than a center of the product information processing apparatus 1. Looking at the product information processing apparatus 1 from the front, the printer 100 may of course be arranged more on a right-hand side than the center of the product information processing apparatus 1. The front refers to a side on which a user such as an operator is positioned, that is, a side indicated by a white arrow in FIG. 1.

Figure 2:
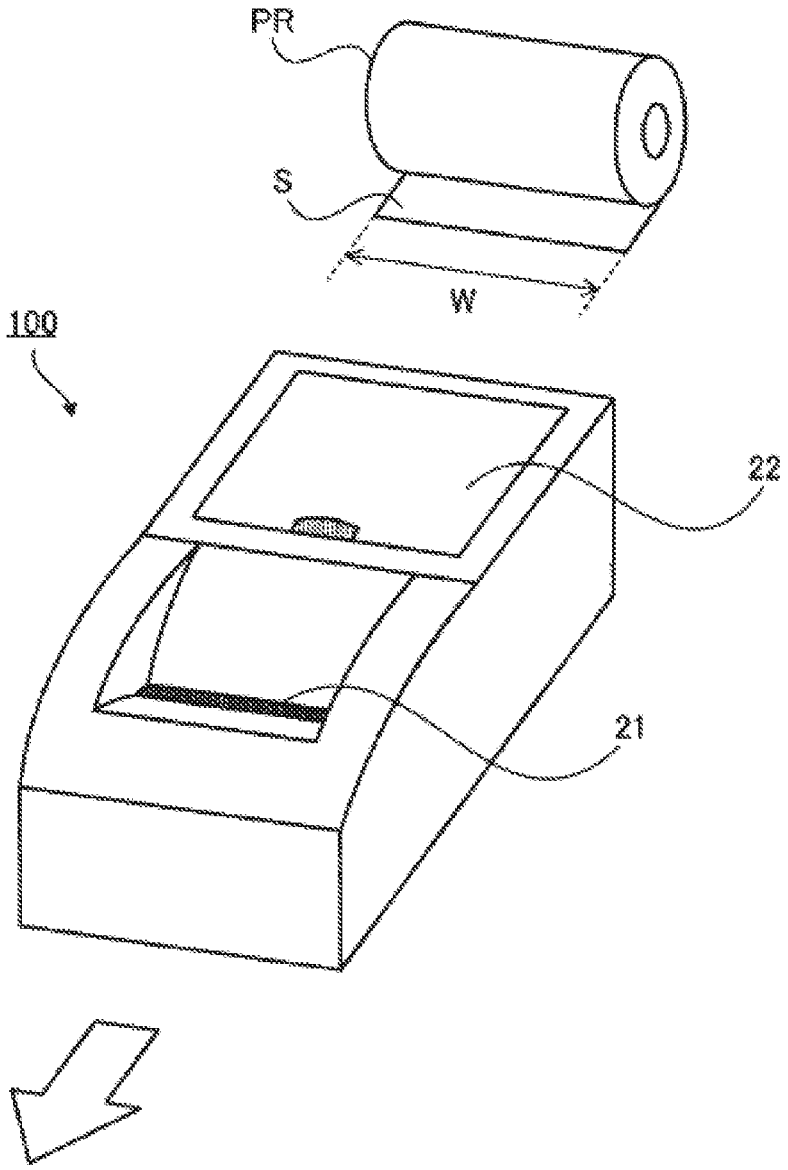
FIG. 2 is a perspective view of the printer according to the embodiment.

FIG. 2 is a diagram showing the printer 100 that has been taken out of the product information processing apparatus 1. The printer 100 is a receipt printer for issuing receipts. The printer 100 detachably supports a roll of paper PR. The roll of paper PR is a roll-type printing medium obtained by rolling paper S. A width of the paper S taken out from the roll of paper PR is the same as that of the roll of paper PR in an axial direction. In descriptions below, the width of the paper S, that is, the width of the roll of paper PR in the axial direction, will be referred to as paper width W. The printer 100 takes out the paper S from the loaded roll of paper PR and prints information on transaction details and the like.

The printer 100 includes an outlet 21 for discharging receipts and a cover 22 provided at an opening for exchanging the roll of paper. The printer 100 prints information on the paper S taken out from the roll of paper PR and discharges it from the outlet 21. When there is no paper S left in the roll of paper PR, the operator opens the cover 22 and exchanges the roll of paper PR.

It should be noted that the outer appearances shown in FIGS. 1 and 2 are mere examples, and various modifications can be made. In descriptions below, the front side of the printer 100 (e.g., side on which user such as operator is positioned) will be referred to as "apparatus-front side", and the other side will be referred to as "apparatus-back side". In the example shown in FIG. 2, the apparatus-front side is the direction indicated by the white arrow, and the apparatus-back side is the opposite direction. The printer 100 is fixed to the product information processing apparatus 1 such that the apparatus-front side is set at the front of the product information processing apparatus 1 and the apparatus-back side is set at the back of the product information processing apparatus 1.

Figure 3:
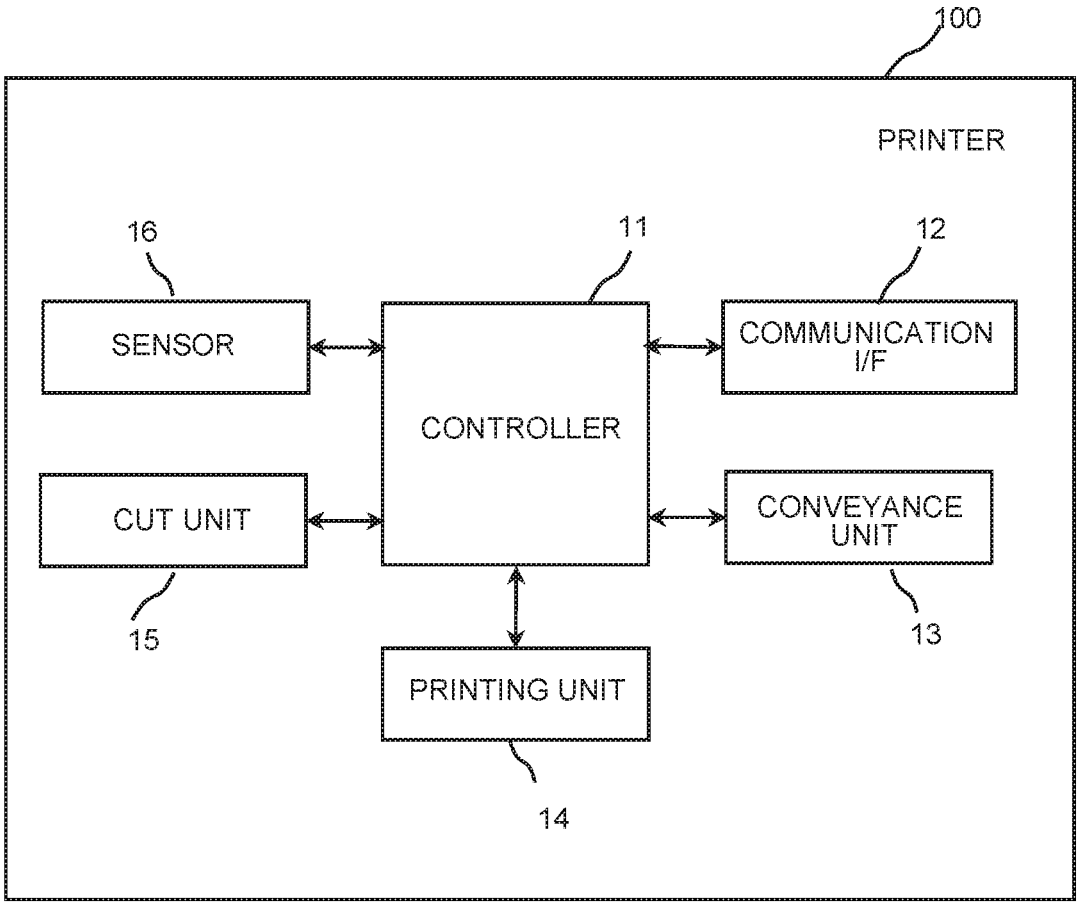
FIG. 3 is a block diagram showing a control configuration of the printer according to the embodiment.
Figure 4:
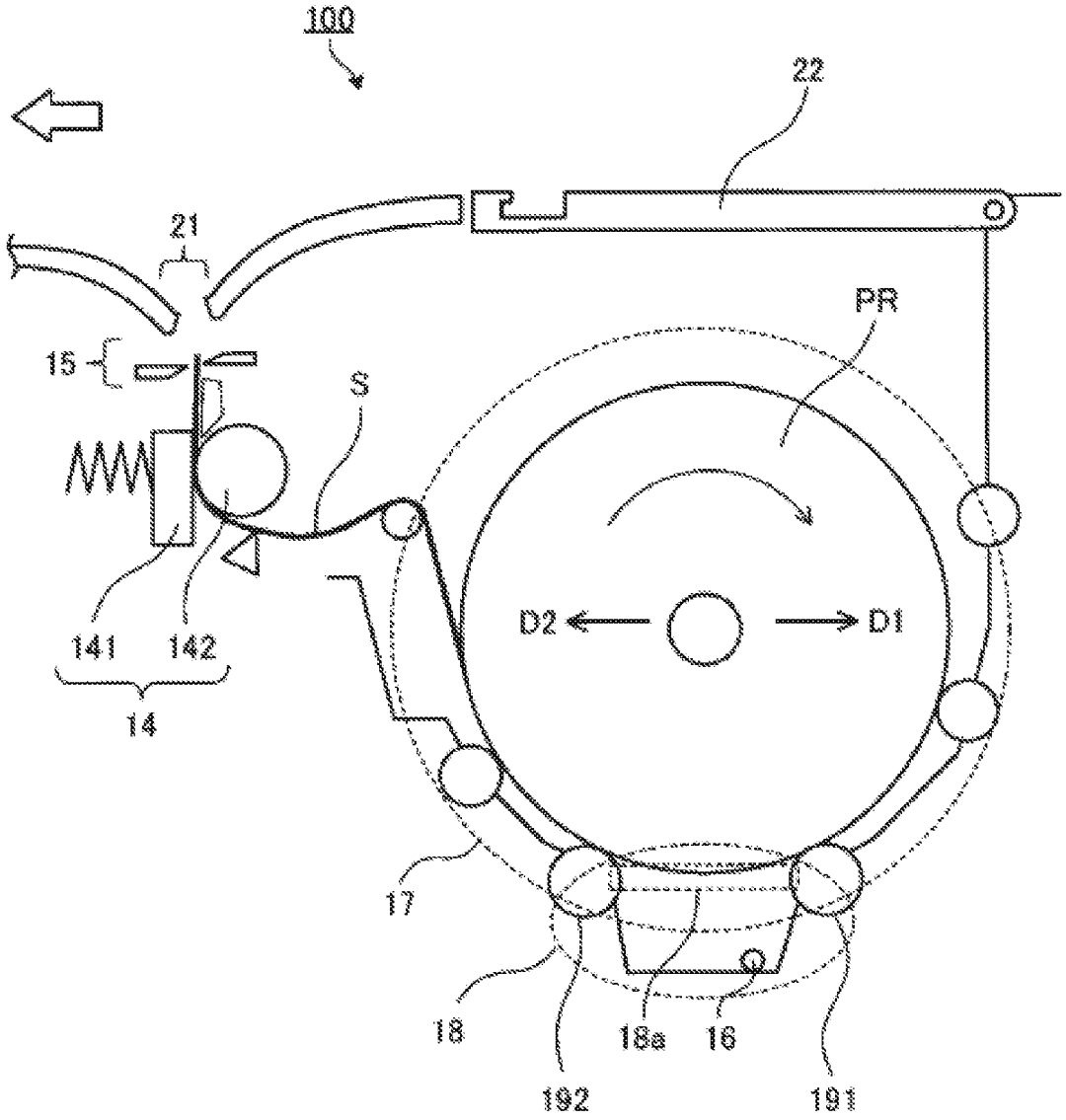
FIG. 4 is a schematic cross-sectional diagram showing an internal structure of the printer according to the embodiment.

FIG. 3 is a block diagram showing a control configuration of the printer 100. Further, FIG. 4 is a diagram showing an internal structure of the printer 100. As shown in FIG. 3, the printer 100 includes a controller 11, a communication interface 12 (communication I/F), a conveyance unit 13, a printing unit 14, a cut unit 15, and a sensor 16.

The controller 11 is a processing apparatus such as a processor. The controller 11 operates in accordance with programs stored in a ROM (Read Only Memory) and a RAM (Random Access Memory) (not shown) to control the respective units of the printer 100.

The communication interface 12 is a communication interface for communicating with a control apparatus (e.g., processor) of the product information processing apparatus 1. The communication interface 12 acquires various types of data from the product information processing apparatus 1. The data that the communication interface 12 acquires from the product information processing apparatus 1 includes information to be printed on a receipt by the printing unit 14 (e.g., transaction details).

The conveyance unit 13 is an apparatus (or mechanism) for conveying the paper S taken out from the roll of paper PR toward the printing unit 14. It is also possible for the paper S to be conveyed by rotations of a platen roller 142 of the printing unit 14 and the conveyance unit 13 to draw out the paper S from the roll of paper PR.

The printing unit 14 is a printing apparatus for printing various types of information such as transaction details on the paper S. The printing unit 14 is a thermal-type printing unit. As shown in FIG. 4, the printing unit 14 includes a thermal head 141 and the platen roller 142. The printing unit 14 prints information on transaction details and the like on the paper S under control of the controller 11.

The cut unit 15 is a cutter for cutting a receipt part from the paper S. The cut unit 15 is a roller cutter that moves in a direction orthogonal to a longitudinal direction of the paper S, for example. Of course, the configuration of the cut unit 15 is not limited thereto and can be variously modified.

As shown in FIG. 4, the printer 100 includes a holder 17 that stores the roll of paper PR. The holder 17 is a clamshell-type holder in which a core of the roll of paper PR is not fixed. A width of the holder 17 is slightly larger than the paper width W of the roll of paper PR so as to enable the roll of paper PR to be stored easily. As the paper S is taken out, the roll of paper PR rotates in the holder 17.

It should be noted that in descriptions below, a direction in which the roll of paper PR moves by being rotated will be referred to as rotation direction, and a direction opposite to the rotation direction will merely be referred to as opposite direction. In the example shown in FIG. 4, the roll of paper PR rotates clockwise in the figure along with the drawing out of the paper S, so the rotation direction is a D1 direction. Further, the opposite direction is a D2 direction. It should be noted that if the roll of paper PR rotates counterclockwise in the figure, be careful since the rotation direction becomes the D2 direction, and the opposite direction becomes the D1 direction. In this embodiment, the rotation direction D1 coincides with the apparatus-back side (back side of product information processing apparatus 1), and the opposite direction D2 coincides with the apparatus-front side (front side of product information processing apparatus 1). Alternatively, the rotation direction D1 may be the apparatus-front side (front side of product information processing apparatus 1), and the opposite direction D2 may be the apparatus-back side (back side of product information processing apparatus 1).

A drop portion 18 is provided at a bottom portion of the holder 17. The drop portion 18 is a portion that catches the roll of paper PR that falls from the holder 17 when a diameter of the roll of paper PR becomes smaller than a preset diameter. The drop portion 18 is a concave portion provided at the bottom portion of the holder 17, for example. When the diameter of the roll of paper PR becomes smaller than the preset diameter, the roll of paper PR falls and fits into the drop portion 18. In descriptions below, the roll of paper PR that has become small enough to fit into the drop portion 18 will be referred to as small-diameter roll PRs.

The sensor 16 is provided in the drop portion 18. The sensor 16 is a sensor for detecting the small-diameter roll PRs. The sensor 16 is, for example, a button switch that is turned ON by a weight of the small-diameter roll PRs. The sensor 16 may alternatively be an optical sensor that detects whether there is a small-diameter roll PRs within a preset distance. For example, the sensor 16 may be a reflective sensor provided on a side surface of the drop portion 18. Alternatively, the sensor 16 may be of other types, such as a combination of an actuator and a photosensor and a combination of an LED (Light Emitting Diode) and a diode. The sensor 16 functions as a detection means for detecting the roll of paper PR fit into the drop portion 18. Upon detecting the roll of paper PR, the sensor 16 notifies the controller 11 that the roll of paper PR has been detected.

In the holder 17, a pair of support rollers 191 and 192 is provided so as to sandwich an inlet 18*a* of the drop portion 18. The support roller 191 is provided on the rotation direction D1 side of the inlet 18*a*, and the support roller 192 is provided on the opposite direction D2 side of the inlet 18*a*.

The support rollers 191 and 192 rotatably support the roll of paper PR at the bottom portion of the holder 17.

Figure 5:
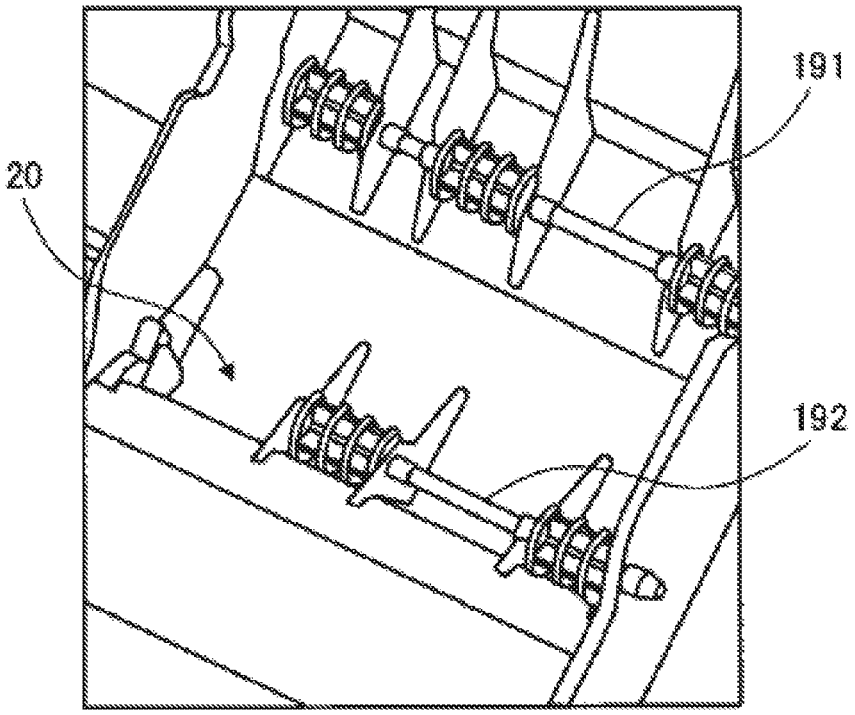
FIG. 5 is a perspective view showing an internal structure of a holder of the printer according to the embodiment.

It should be noted that in descriptions below, the support roller provided on the rotation direction side of the inlet of the drop portion will be referred to as progression-side support roller, and the support roller provided on the opposite direction side will be referred to as opposite-side support roller. In the case of this embodiment, the support roller 191 is the progression-side support roller, and the support roller 192 is the opposite-side support roller. FIG. 5 is a diagram showing the holder 17 seen from an upper oblique direction. FIG. 5 shows a state where the support rollers 191 and 192 are provided in the holder 17. The support rollers 191 and 192 are each an elongated roller. The support rollers 191 and 192 are fixed to the holder 17 such that axial directions thereof become parallel to the axial direction of the roll of paper PR.

Figure 6:
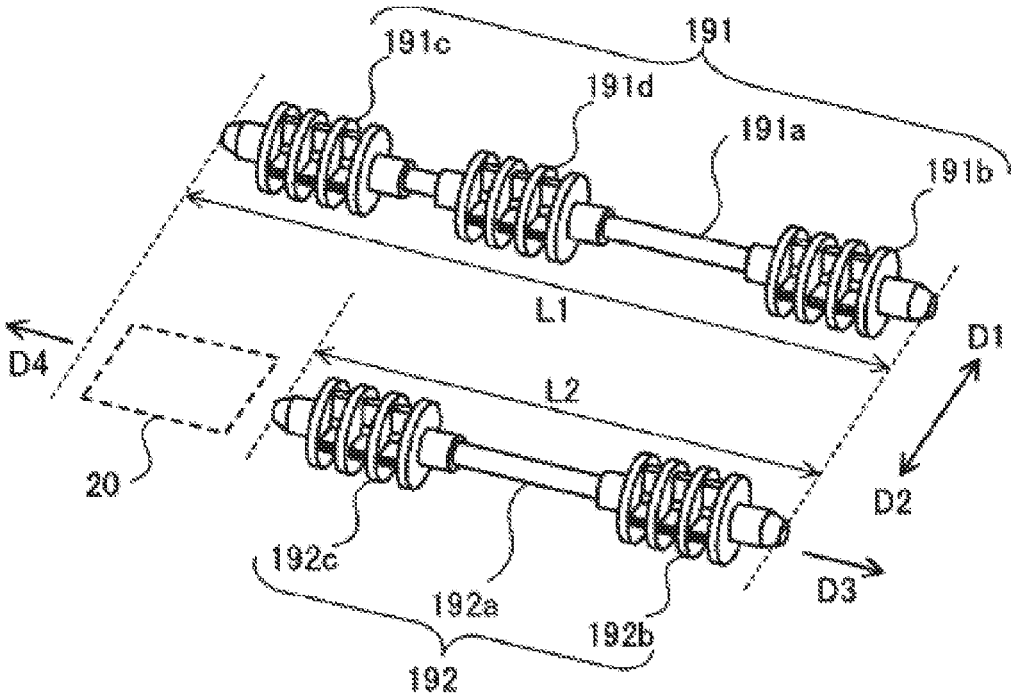
FIG. 6 is a perspective view of support rollers of the printer according to the embodiment.

FIG. 6 is a diagram showing only the support rollers 191 and 192 that have been taken out of the printer 100, without changing a positional relationship between the support rollers 191 and 192.

The support roller 191 includes a shaft 191*a* and 3 roller portions 191*b*, 191*c*, and 191*d* arranged on the shaft 191*a*. The support roller 191 is a long-width roller. The long-width roller is a roller whose width in an axial direction of the shaft is equal to or larger than the paper width of the roll of paper. In the case of this embodiment, a width L1 of the shaft 191*a* in the axial direction is larger than the paper width W of the roll of paper PR. Of course, the width L1 of the shaft 191*a* may be the same as the paper width W. It should be noted that even when there is a slight difference between the two widths (e.g., difference of ±10%), the widths can be considered as the same width. Specifically, as long as the width L1 of the shaft 191*a* is within the range of 90% to 110% of the paper width W of the roll of paper PR, the width L1 of the shaft 191*a* and the paper width W of the roll of paper PR are considered to be the same.

The support roller 192 includes a shaft 192*a* and two roller portions 192*b* and 192*c* arranged on the shaft 192*a*. The support roller 192 is a short-width roller. The short-width roller is a roller whose width in an axial direction of the shaft is smaller than the paper width of the roll of paper. In the case of this embodiment, a width L2 of the shaft 192*a* in the axial direction is smaller than the paper width W of the roll of paper PR. The support roller 192 is fixed on a right-hand side (D3 side in figure) when seen from the apparatus-front side.

A diameter of the roller portions 192*b* and 192*c* of the support roller 192 is the same as that of the roller portions 191*b*, 191*c*, and 191*d* of the support roller 191. However, the diameters may differ. For example, the diameter of the roller portions 192*b* and 192*c* may be smaller than that of the roller portions 191*b*, 191*c*, and 191*d* of the support roller 191. An interval between the support rollers 191 and 192, that is, a distance between outer circumferences of the roller portions of the support roller 191 and outers circumference of the roller portions of the support roller 192, that is seen from the axial direction of the roll of paper PR, is the same as the diameter of the roll of paper PR that an apparatus designer intends for the apparatus to detect, for example.

It should be noted that the support rollers 191 and 192 shown in the figure are a mere example. The configurations of the support rollers 191 and 192 can be variously modified. For example, the number of roller portions of each of the support rollers 191 and 192 may be larger or smaller than the number (3 or 2) shown in the figure. The configuration of the roller portions can also be changed arbitrarily. For example, the roller portion may be one simple cylindrical member instead of a member in which a plurality of disc-like members are laminated as shown in FIG. 6. One roller portion may be provided in one support roller. A width of the roller portion in the axial direction may be slightly smaller than that of the shaft (e.g., width smaller by about 10 to 30%).

As described above, the support roller 192 is a short-width roller. Therefore, a part where the shaft 192*a* is not arranged is formed at an extension portion of the support roller 192 in the axial direction. In descriptions below, the part where the shaft is not arranged, which is formed at the extension portion of the short-width roller in the axial direction inside the holder 17 of the roll of paper PR, will be referred to as non-shaft arrangement part. As shown in FIG. 6, the support roller 192 of this embodiment is arranged more on the right-hand side when seen from the apparatus-front side. Therefore, the non-shaft arrangement part is formed on the left-hand side of the support roller 192. In the example shown in FIG. 6, the non-shaft arrangement part is arranged on a D4 side of the support roller 192.

The non-shaft arrangement part becomes a void 20 into which a finger of a person can be inserted. This void 20 is a square area whose widths in longitudinal (D1-D2 direction) and lateral (D3-D4 direction) directions are 1.5 cm to 3 cm, for example. Of course, the size of the void 20 is not limited to this example. The widths of the void 20 may be larger than or smaller than 1.5 cm to 3 cm. By forming the void 20 inside the holder 17, the user can easily access a peripheral surface of the small-diameter roll PRs using fingers.

Next, operations of the printer 100 including such a configuration will be described.

The controller 11 of the printer 100 starts printing on the basis of a printing command from the product information processing apparatus 1. The controller 11 controls the conveyance unit 13 to take out the paper S from the roll of paper PR and also controls the printing unit 14 to print information on the paper S. The controller 11 cuts a part where information has been printed from the paper S and discharges it as a receipt from the outlet 21.

Figure 7:
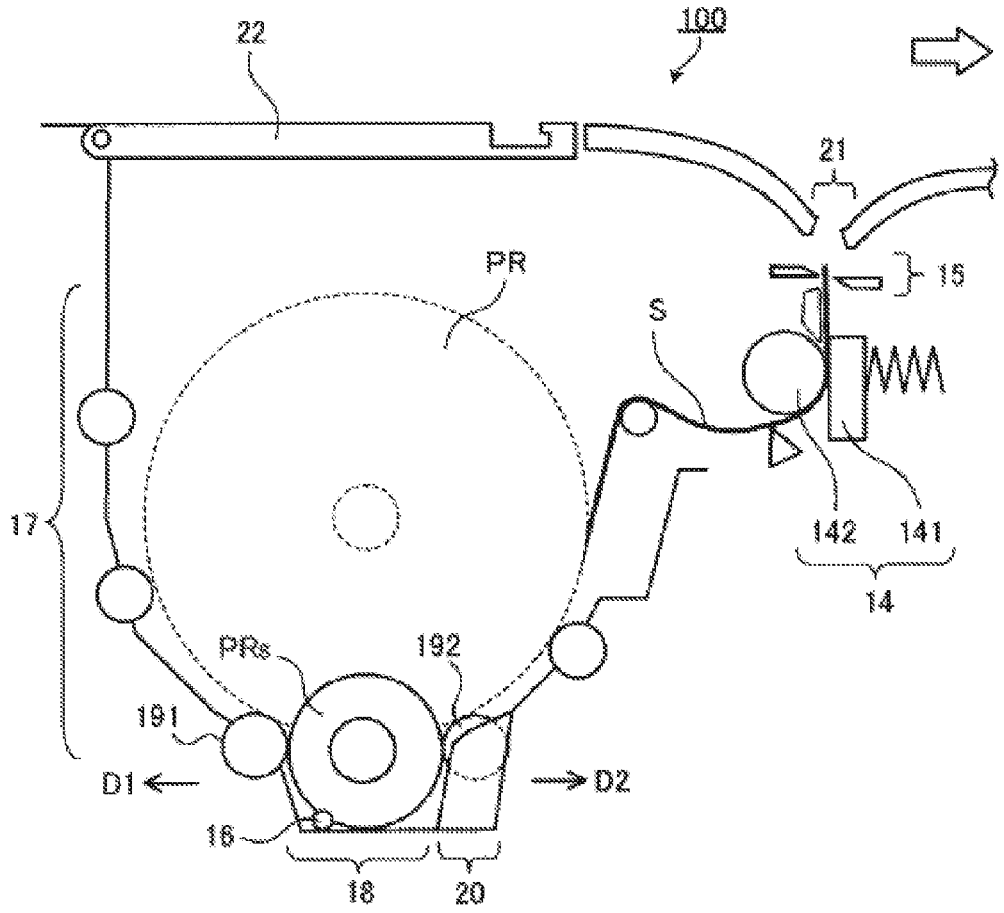
FIG. 7 is a diagram showing a state where a small-diameter roll is fit into a drop portion in the printer according to the embodiment.

By repeating printing, the diameter of the roll of paper PR becomes small. Eventually, the roll of paper PR becomes as small as the small-diameter roll PRs. The holder 17 is a clamshell-type holder in which a core of the roll of paper PR is not fixed. Therefore, when the roll of paper PR becomes as small as the small-diameter roll PRs, the roll of paper PR falls and fits into the drop portion 18 provided at the bottom portion of the holder 17. FIG. 7 is a diagram showing a state where the small-diameter roll PRs is fit into the drop portion 18.

When the small-diameter roll PRs fits into the drop portion 18, the sensor 16 detects the small-diameter roll PRs. Then, the sensor 16 notifies the controller 11 that the small-diameter roll PRs has been detected. Upon being notified by the sensor 16, the controller 11 notifies the operator that the time to exchange the roll of paper PR has come. For example, the controller 11 outputs the fact that the time to exchange the roll of paper PR has come to an output apparatus (e.g., display, speaker, and light-emitting apparatus) of the product information processing apparatus 1 via a control apparatus of the product information processing apparatus 1. If the printer 100 includes an output apparatus such as a display, a speaker, and a light-emitting apparatus, the controller 11 may output the fact that the time to exchange the roll of paper PR has come to the output apparatus of the printer 100.

Figure 8:
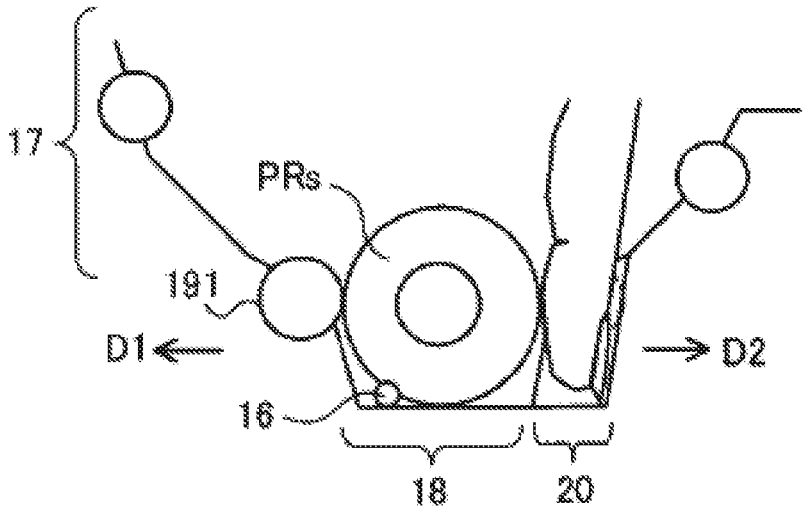
FIG. 8 is a diagram showing a state where the small-diameter roll is taken out in the printer according to the embodiment.

When the time to exchange the roll of paper PR comes, the operator exchanges the roll of paper PR (small-diameter roll PRs). FIG. 8 is a diagram showing a state where the operator takes out the small-diameter roll PRs from the drop portion 18. As described above, the void 20 into which a finger of a person can be inserted is formed on the D2 side of the drop portion 18. The operator inserts a finger into the void 20 and takes out the small-diameter roll PRs from the drop portion 18 as shown in FIG. 8.

According to this embodiment, one of the support rollers (support roller 192) arranged at the bottom portion of the holder 17 is the short-width roller. In addition, the non-shaft arrangement part provided at the extension portion of the shaft of the short-width roller in the axial direction is the void 20 into which a finger of a person can be inserted. Therefore, the user such as an operator can easily take out the roll of paper PR (small-diameter roll PRs) fit into the drop portion 18 with a finger.

Further, the progression-side support roller (support roller 191 in this embodiment) is the long-width roller. When the printer 100 takes out the paper S from the roll of paper PR, the roll of paper PR progresses in the rotation direction Dl. Since the support roller 191 on the rotation direction D1 side is the long-width roller, the rotation of the roll of paper PR inside the holder 17 is stabilized.

Furthermore, in the printer 100 of this embodiment, the support roller 192 as the short-width roller is arranged on the apparatus-front side, and the short-width roller is arranged more on the right-hand side (e.g., D3 side in FIG. 6). Therefore, when grabbing the small-diameter roll PRs with a right hand, the void 20 is positioned right at a position of a thumb. As a result, the user grabbing the small-diameter roll PRs with a right hand can easily take out the small-diameter roll PRs from the drop portion 18.

Particularly in a case where the printer 100 is arranged more on the left-hand side than the center of the product information processing apparatus 1 when seen from the front of the product information processing apparatus 1 as shown in FIG. 1, many operators take out the small-diameter roll PRs with their left hands irrespective of whether the operators are left-handed or right-handed. Therefore, by arranging the short-width roller (support roller 192) more on the right-hand side (D3 side) as shown in FIG. 6 in the case where the printer 100 is arranged on the left-hand side of the product information processing apparatus 1, the operator can easily take out the small-diameter roll PRs from the drop portion 18.

Second Embodiment

Figure 9:
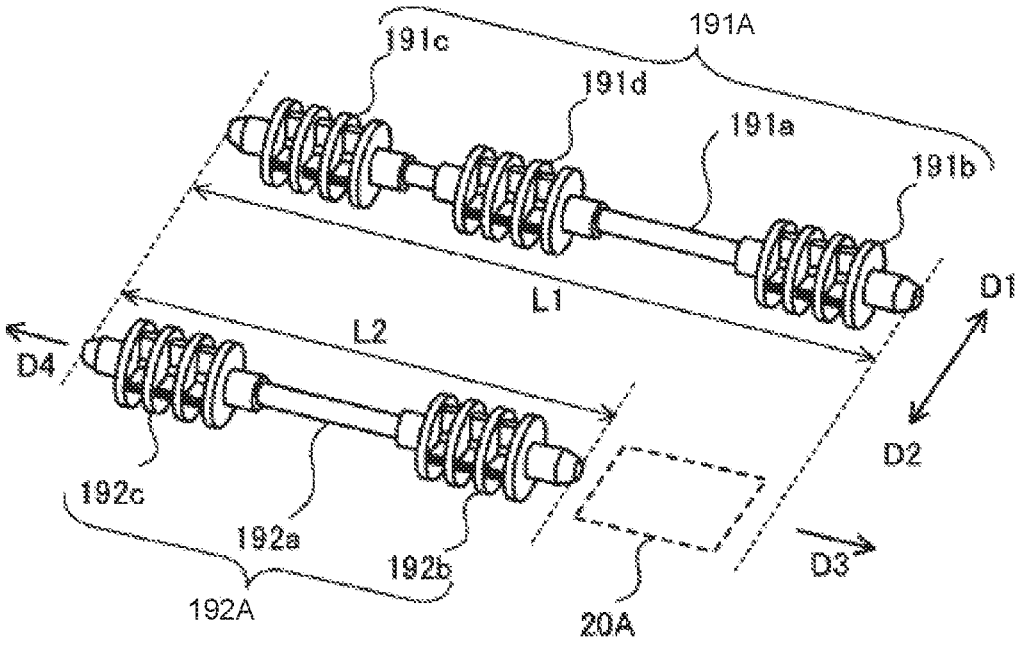
FIG. 9 is a perspective view of support rollers according to another embodiment.

In the first embodiment, the short-width roller (support roller 192) is arranged more on the right-hand side when seen from the apparatus-front side (front of printer 100). However, the short-width roller may alternatively be arranged more on the left-hand side (D4 side) when seen from the apparatus-front side. FIG. 9 is a diagram showing support rollers 191A and 192A according to a second embodiment.

The support roller 191A is a long-width roller including a shaft 191*a* and roller portions 191*b*, 191*c*, and 191*d*. The support roller 192A is a short-width roller including a shaft 192*a* and roller portions 192*b* and 192*c*. The support roller 191A is the progression-side support roller, and the support roller 192A is the opposite-side support roller.

The support roller 192A is arranged on the apparatus-front side and arranged more on the left-hand side (D4 side) when seen from the apparatus-front side. Therefore, a non-shaft arrangement part formed on the right-hand side (D3 side) of the support roller 192A becomes a void 20A. A finger of a person can be inserted into the void 20A. The size of the void 20A may be the same as that of the void 20 shown in FIG. 6.

With such a configuration, when the user grabs the small-diameter roll PRs with a left hand, the void 20A is positioned right at the position of a thumb. As a result, the user grabbing the small-diameter roll PRs with the left hand can easily take out the small-diameter roll PRs from the drop portion 18.

Particularly in a case where the printer 100 is arranged on the left-hand side of the product information processing apparatus 1 when seen from the front of the product information processing apparatus 1 as shown in FIG. 1, many operators take out the small-diameter roll PRs with their left hands irrespective of whether the operators are left-handed or right-handed. Therefore, by arranging the short-width roller (support roller 192A) more on the left-hand side (D4 side) as shown in FIG. 9 in the case where the printer 100 is arranged on the left-hand side of the product information processing apparatus 1, the user can easily take out the small-diameter roll PRs from the drop portion 18.

Third Embodiment

Figure 10:
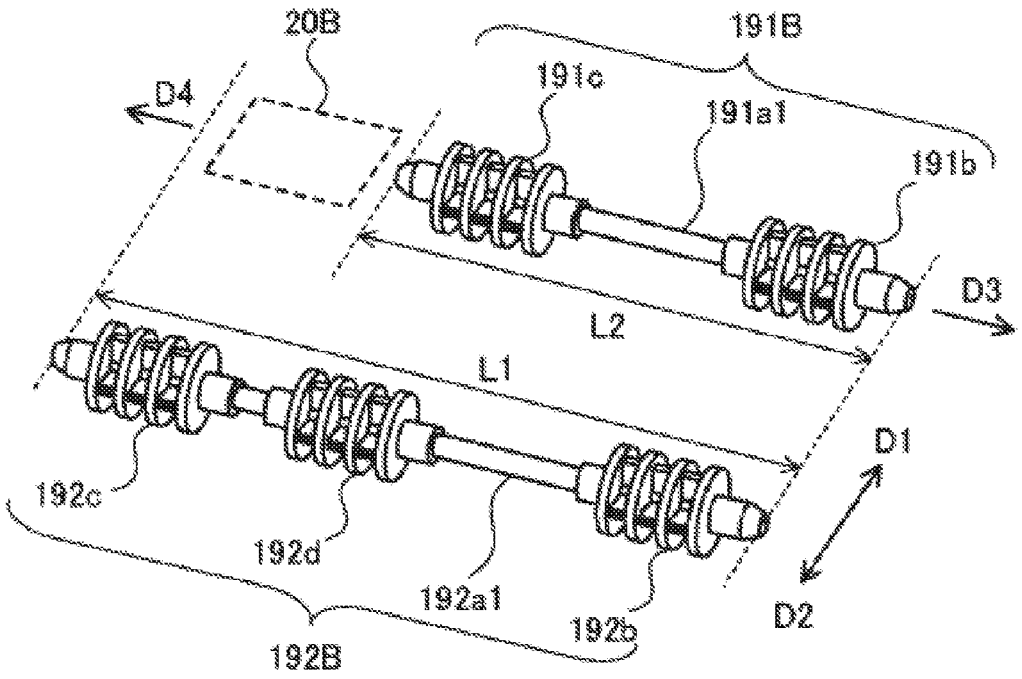
FIG. 10 is a perspective view of support rollers according to another embodiment.

In the first embodiment, the progression-side support roller (support roller 191 in the case of the example shown in FIG. 6) is the long-width roller, and the opposite-side support roller (support roller 192 in the case of the example shown in FIG. 6) is the short-width roller. However, the progression-side support roller may be the short-width roller, and the opposite-side support roller may be the long-width roller. FIG. 10 is a diagram showing support rollers 191B and 192B according to a third embodiment.

The support roller 191B is a short-width roller including a shaft 191*a*1 and roller portions 191*b* and 191*c*. The support roller 192B is a long-width roller including a shaft 192*a*1 and roller portions 192*b*, 192*c*, and 192*d*. The support roller 191B is the progression-side support roller, and the support roller 192B is the opposite-side support roller.

As shown in FIG. 10, the support roller 191B is arranged more on the right-hand side (D3 side) when seen from the apparatus-front side. Therefore, a non-shaft arrangement part formed on the left-hand side (D4 side) of the support roller 191B becomes a void 20B. A finger of a person can be inserted into the void 20B. The size of the void 20B may be the same as that of the void 20 shown in FIG. 6.

According to this embodiment, the small-diameter roll PRs can be easily taken out by an index finger or a pinky. It should be noted that although the support roller 191B (short-width roller) as the progression-side support roller is arranged on the right-hand side (D3 side) when seen from the apparatus-front side in the example shown in FIG. 10, the support roller 191B may alternatively be arranged on the left-hand side (D4 side). In this case, the void 20B is formed on the right-hand side (D3 side) of the support roller 191B.

Fourth Embodiment

Figure 11:
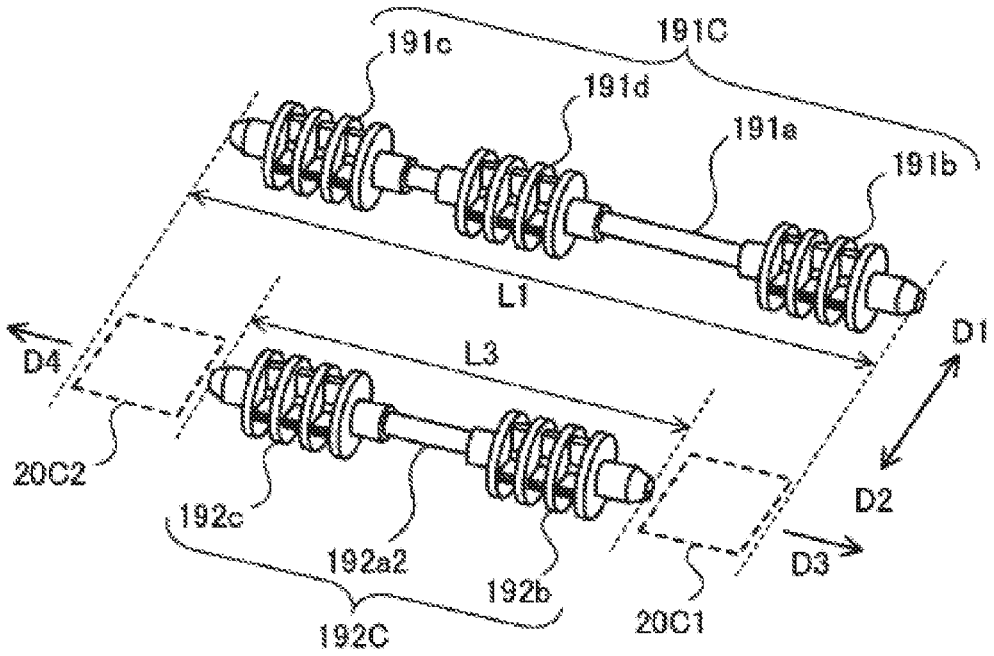
FIG. 11 is a perspective view of support rollers according to another embodiment.

In the first embodiment, the short-width roller (support roller 192 in the case of the example shown in FIG. 6) is arranged more on one side of the holder 17 than the other in the axial direction. However, the short-width roller may be arranged in the middle in the axial direction so that voids are formed at extension portions on both sides in the axial direction. FIG. 11 is a diagram showing support rollers 191C and 192C according to a fourth embodiment.

The support roller 191C is a long-width roller including a shaft 191*a* and roller portions 191*b*, 191*c*, and 191*d*. The support roller 192C is a short-width roller including a shaft 192*a*2 and roller portions 192*b* and 192*c*. The support roller 191C is the progression-side support roller, and the support roller 192C is the opposite-side support roller.

A width L3 of the shaft 192*a*2 of the short-width roller (support roller 192C) is set to a length with which voids into which a finger of a person can be inserted are formed on both sides of the shaft 192*a*2 in the axial direction. For example, the width L3 is half the width L1 of the long-width roller. Therefore, the extension portions (non-shaft arrangement parts) of the shaft 192*a*2 of the short-width roller (support roller 192C) in the axial direction are voids into which a finger of a person can be inserted. Specifically, a void 20C1 is formed on the right-hand side (D3 side) of the support roller 192C, and a void 20C2 is formed on the left-hand side (D4 side). The size of the voids 20C1 and 20C2 may be the same as that of the void 20 shown in FIG. 6.

According to this embodiment, since both sides of the short-width roller are voids, the small-diameter roll PRs can be easily taken out of the drop portion 18 in both cases of exchanging the roll of paper PR with a left hand and exchanging the roll of paper PR with a right hand.

Fifth Embodiment

Figure 12:
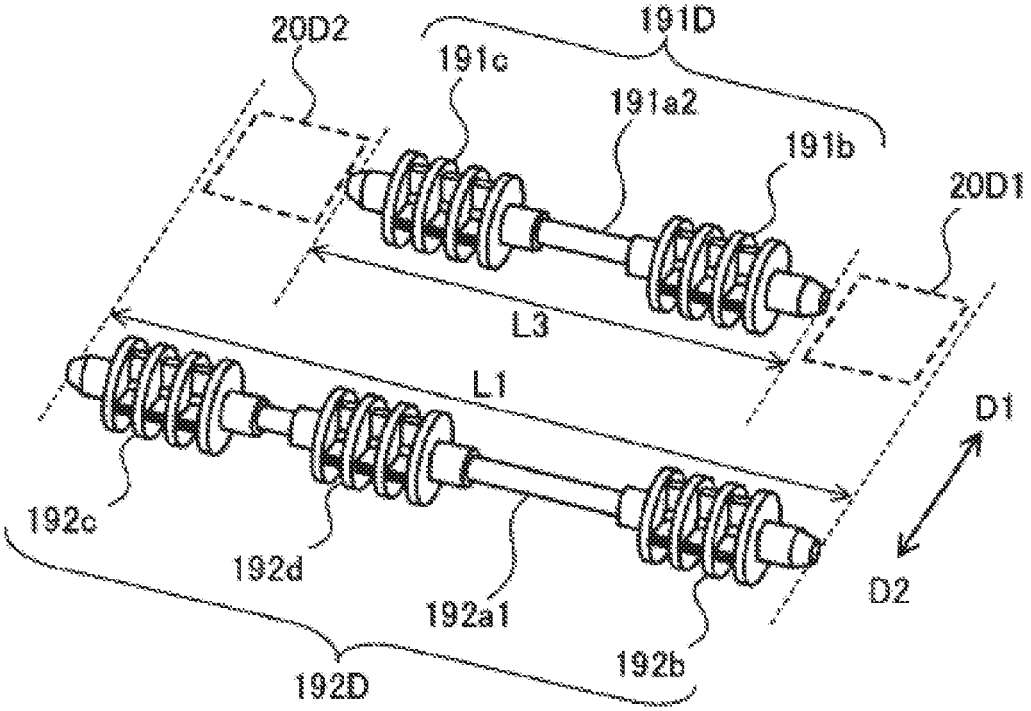
FIG. 12 is a perspective view of support rollers according to another embodiment.

In the fourth embodiment, the progression-side support roller is the long-width roller (support roller 191C), and the opposite-side support roller is the short-width roller (support roller 192C). However, the progression-side support roller may be the short-width roller. FIG. 12 is a diagram showing support rollers 191D and 192D as a modified example of the support rollers 191 and 192.

The support roller 191D is a short-width roller including a shaft 191*a*2 and roller portions 191*b* and 191*c*. The support roller 192D is a long-width roller including a shaft 192*a*1 and roller portions 192*b*, 192*c*, and 192*d*. The support roller 191D is the progression-side support roller, and the support roller 192D is the opposite-side support roller.

A width L3 of the shaft 191*a*2 of the short-width roller (support roller 191D) is set to a length with which voids into which a finger of a person can be inserted are formed on both sides of the shaft 191*a*2 in the axial direction. Therefore, the extension portions (non-shaft arrangement parts) of the short-width roller (support roller 191D) in the axial direction are voids into which a finger of a person can be inserted. Specifically, a void 20D1 is formed on the right-hand side (D3 side) of the support roller 191D, and a void 20D2 is formed on the left-hand side (D4 side). The size of the voids 20D1 and 20D2 may be the same as that of the void 20 shown in FIG. 6.

According to this embodiment, since both sides of the short-width roller are voids, the small-diameter roll PRs can be easily taken out of the drop portion 18 in both cases of exchanging the roll of paper PR with a left hand and exchanging the roll of paper PR with a right hand.

Sixth Embodiment

Figure 13:
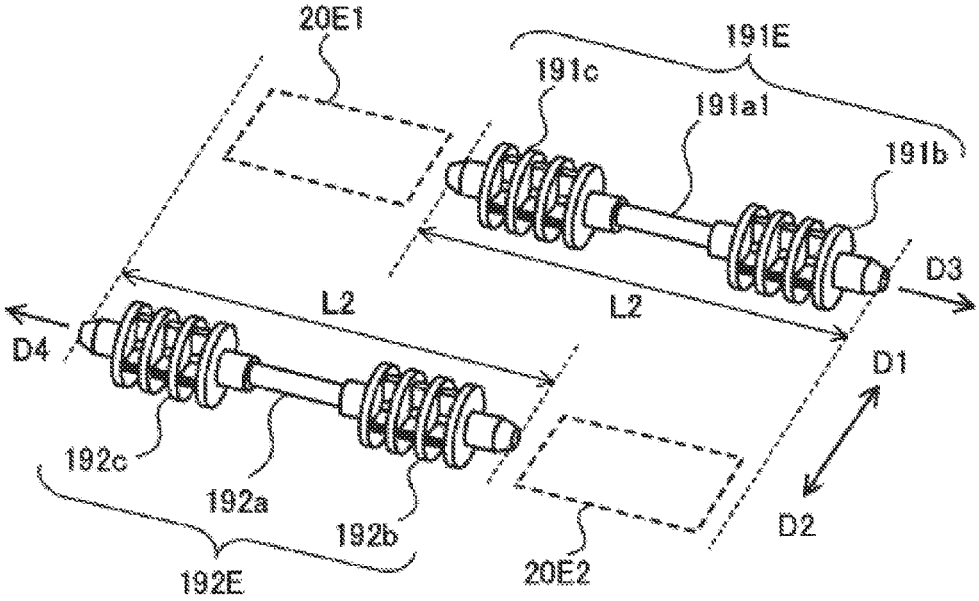
FIG. 13 is a perspective view of support rollers according to another embodiment.

In the first embodiment, one of the progression-side support roller and the opposite-side support roller is the long-width roller, and the other one is the short-width roller. However, the progression-side support roller and the opposite-side support roller may both be the short-width roller. FIG. 13 is a diagram showing support rollers 191E and 192E according to a sixth embodiment.

The support roller 191E is a short-width roller including a shaft 191*a*1 and roller portions 191*b* and 191*c*. The support roller 192E is a short-width roller including a shaft 192*a* and roller portions 192*b* and 192*c*. The support roller 191E is the progression-side support roller, and the support roller 192E is the opposite-side support roller.

The progression-side support roller 191E is arranged more on one side than the other in the axial direction, and the support roller 192E is arranged more on the other side opposite to the side on which the support roller 191E is arranged. More specifically, the support roller 191E is arranged more on the right-hand side (D3 side) when seen from the apparatus-front side, and the support roller 192E is arranged more on the left-hand side (D4 side) when seen from the apparatus-front side.

A non-shaft arrangement part formed on the left-hand side (D4 side) of the support roller 191E is a void 20E1, and a non-shaft arrangement part formed on the right-hand side (D3 side) of the support roller 192E is a void 20E2. A finger of a person can be inserted into the voids 20E1 and 20E2. The size of the voids 20E1 and 20E2 may be the same as that of the void 20 shown in FIG. 6. It should be noted that although the widths of the shafts 191*a*1 and 192*a* are both L2 in the example shown in FIG. 13, the widths may differ.

According to this embodiment, since the voids are formed on both the rotation direction D1 side and the opposite direction D2 side, it becomes possible to take out the small-diameter roll PRs with a thumb and also take out the small-diameter roll PRs with an index finger or a pinky.

Seventh Embodiment

Figure 14:
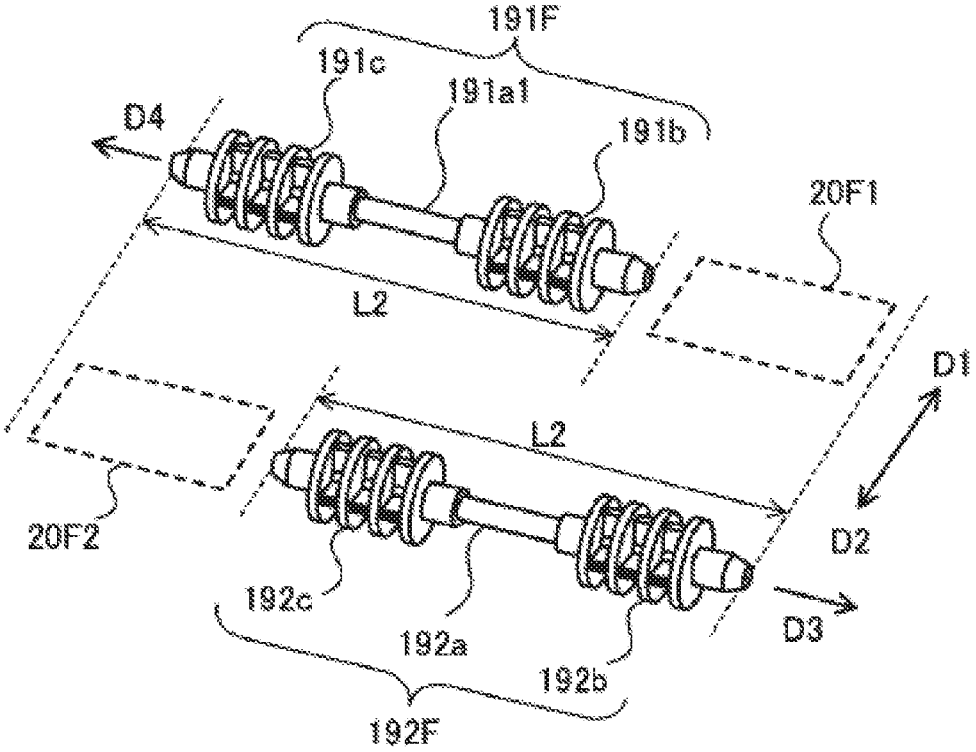
FIG. 14 is a perspective view of support rollers according to another embodiment.

In the sixth embodiment, the progression-side support roller 191E is arranged more on the right-hand side (D3 side), and the opposite-side support roller 192E is arranged more on the left-hand side (D4 side). However, the progression-side support roller may be arranged more on the left-hand side (D4 side), and the opposite-side support roller may be arranged more on the right-hand side (D3 side). FIG. 14 is a diagram showing support rollers 191F and 192F according to a seventh embodiment.

The support roller 191F is a short-width roller including a shaft 191*a*1 and roller portions 191*b* and 191*c*. The support roller 192F is a short-width roller including a shaft 192*a* and roller portions 192*b* and 192*c*. The support roller 191F is arranged more on the left-hand side (D4 side) when seen from the apparatus-front side, and the support roller 192F is arranged more on the right-hand side (D3 side) when seen from the apparatus-front side.

A non-shaft arrangement part formed on the right-hand side (D3 side) of the support roller 191F is a void 20F1, and a non-shaft arrangement part formed on the left-hand side (D4 side) of the support roller 192F is a void 20F2. A finger of a person can be inserted into the voids 20F1 and 20F2. The size of the voids 20F1 and 20F2 may be the same as that of the void 20 shown in FIG. 6.

It should be noted that although the widths of the shafts 191*a*1 and 192*a* are both L2 in the example shown in FIG. 14, the widths may differ.

According to this embodiment, since the voids are formed on both the rotation direction D1 side and the opposite direction D2 side, it becomes possible to take out the small-diameter roll PRs with a thumb and also take out the small-diameter roll PRs with an index finger or a pinky.

Eighth Embodiment

Figure 15:
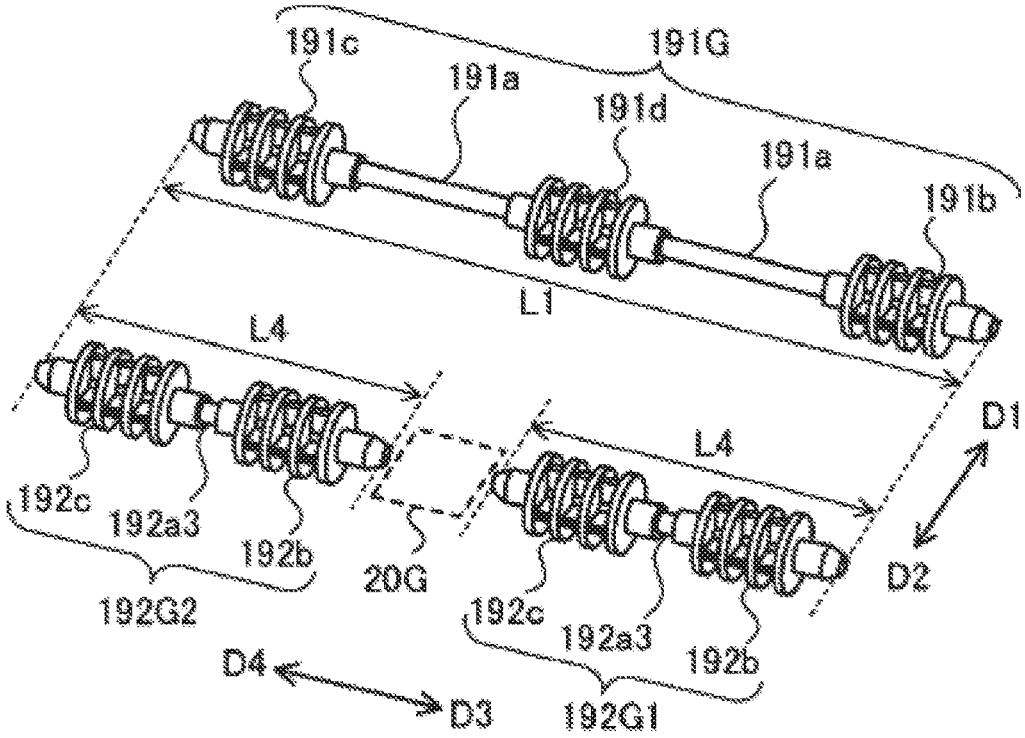
FIG. 15 is a perspective view of support rollers according to another embodiment.

In the first embodiment, only one support roller is arranged on the opposite direction D2 side of the inlet 18*a* of the drop portion 18. However, a plurality of support rollers may be arranged on the opposite direction D2 side of the inlet 18*a*. FIG. 15 is a diagram showing support rollers 191G, 192G1, and 192G2 according to an eighth embodiment.

The support roller 191G (progression-side support roller) is a long-width roller including a shaft 191*a* and roller portions 191*b*, 191*c*, and 191*d*. The support roller 192G1 (first opposite-side support roller) is a short-width roller including a shaft 192*a*3 and roller portions 192*b* and 192*c*. The support roller 192G2 (second opposite-side support roller) is a short-width roller including a shaft 192*a*3 and roller portions 192*b* and 192*c*. The support roller 192G1 is arranged more on the right-hand side (D3 side) when seen from the apparatus-front side, and the support roller 192G2 is arranged more on the left-hand side (D4 side) when seen from the apparatus-front side.

The support rollers 192G1 and 192G2 are aligned such that axial directions of the shafts 192*a*3 thereof coincide. A non-shaft arrangement part formed between the support rollers 192G1 and 192G2 becomes a void 20G. A finger of a person can be inserted into the void 20G. The size of the void 20G may be the same as that of the void 20 shown in FIG. 6.

It should be noted that although the width of the shaft 192*a*3 of the support roller 192G1 and that of the shaft 192*a*3 of the support roller 192G2 are both L4 in the example shown in FIG. 15, the widths may differ.

According to this embodiment, since the void 20G is formed at the center, the roll of paper PR (small-diameter roll PRs) fit into the drop portion 18 can be taken out easily. If the void 20G is arranged at the center of the roll of paper PR in the axial direction in particular, a finger will be positioned near a barycenter of the small-diameter roll PRs. Therefore, even when the small-diameter roll PRs is picked up, the small-diameter roll PRs is not tilted in the left- or right-hand direction. As a result, the small-diameter roll PRs can be taken out more easily.

Ninth Embodiment

Figure 16:
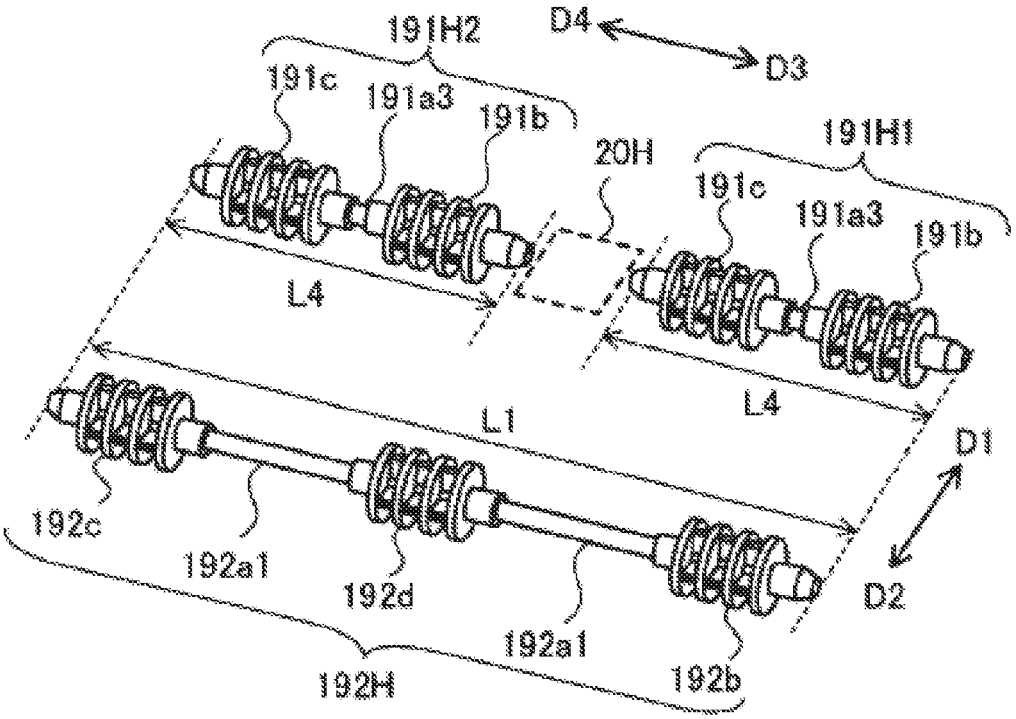
FIG. 16 is a perspective view of support rollers according to another embodiment.

In the eighth embodiment, the plurality of support rollers are arranged on the opposite direction D2 side of the inlet 18*a* of the drop portion 18. However, the plurality of support rollers may be arranged on the rotation direction Dl side of the inlet 18*a*. FIG. 16 is a diagram showing support rollers 191H1, 191H2, and 192H according to a ninth embodiment.

The support roller 191H1 (first progression-side support roller) is a short-width roller including a shaft 191*a*3 and roller portions 191*b* and 191*c*. The support roller 191H2 (second progression-side support roller) is a short-width roller including a shaft 191*a*3 and roller portions 191*b* and 191*c*. The support roller 192H (opposite-side support roller) is a long-width roller including a shaft 192*a*1 and roller portions 192*b*, 192*c*, and 192*d*. The support roller 191H1 is arranged more on the right-hand side (D3 side) when seen from the apparatus-front side, and the support roller 191H2 is arranged more on the left-hand side (D4 side) when seen from the apparatus-front side.

The support rollers 191H1 and 191H2 are aligned such that axial directions of the shafts 191*a*3 thereof coincide. A non-shaft arrangement part formed between the support rollers 191H1 and 191H2 becomes a void 20H. A finger of a person can be inserted into the void 20H. The void 20H may be arranged at the center of the roll of paper PR in the axial direction. The size of the void 20H may be the same as that of the void 20 shown in FIG. 6.

It should be noted that although the width of the shaft 191*a*3 of the support roller 191H1 and that of the shaft 191*a*3 of the support roller 191H2 are both L4 in the example shown in FIG. 16, the widths may differ.

According to this embodiment, since the void 20H is formed at the center, the roll of paper PR (small-diameter roll PRs) fit into the drop portion 18 can be taken out easily. If the void 20H is arranged at the center of the roll of paper PR in the axial direction in particular, a finger will be positioned near a barycenter of the small-diameter roll PRs. Therefore, even when the small-diameter roll PRs is picked up, the small-diameter roll PRs is not tilted in the left- or right-hand direction. As a result, the small-diameter roll PRs can be taken out more easily.

Tenth Embodiment

Figure 17:
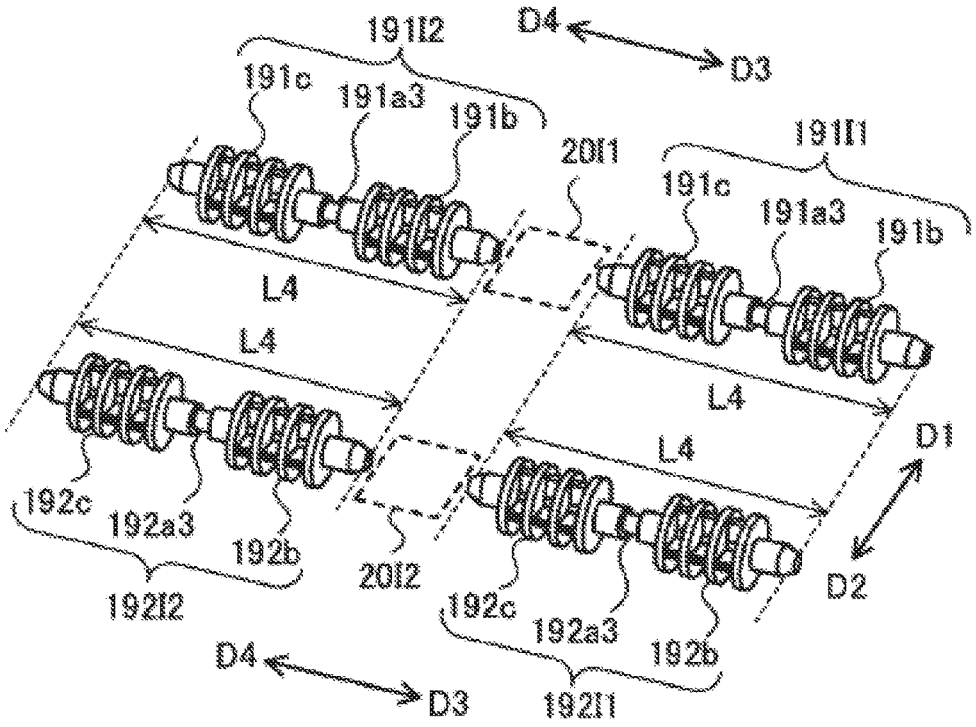
FIG. 17 is a perspective view of support rollers according to another embodiment.

In the eighth and ninth embodiments, the plurality of support rollers are arranged on one of the rotation direction D1 side and the opposite direction D2 side. However, the plurality of support rollers may be arranged on both the rotation direction D1 side and the opposite direction D2 side. FIG. 17 is a diagram showing support rollers 191I1, 191I2, 192I1, and 192I2 according to a tenth embodiment.

The support roller 191I1 (first progression-side support roller) is a short-width roller including a shaft 191*a*3 and roller portions 191*b* and 191*c*. The support roller 191I2 (second progression-side support roller) is a short-width roller including a shaft 191*a*3 and roller portions 191*b* and 191*c*. The support roller 192I1 (first opposite-side support roller) is a short-width roller including a shaft 192*a*3 and roller portions 192*b* and 192*c*. The support roller 192I2 (second opposite-side support roller) is a short-width roller including a shaft 192*a*3 and roller portions 192*b* and 192*c*.

The support rollers 191I1 and 191I2 are aligned such that axial directions of the shafts 191*a*3 thereof coincide. The support roller 191I1 is arranged more on the right-hand side (D3 side) when seen from the apparatus-front side, and the support roller 191I2 is arranged more on the left-hand side (D4 side) when seen from the apparatus-front side. The support rollers 192I1 and 192I2 are aligned such that axial directions of the shafts 192*a*3 thereof coincide. The support roller 192I1 is arranged more on the right-hand side (D3 side) when seen from the apparatus-front side, and the support roller 192I2 is arranged more on the left-hand side (D4 side) when seen from the apparatus-front side.

A non-shaft arrangement part formed between the support rollers 191I1 and 191I2 becomes a void 20I1 (first non-shaft arrangement part). Moreover, a non-shaft arrangement part formed between the support rollers 192I1 and 192I2 becomes a void 20I2 (second non-shaft arrangement part). A finger of a person can be inserted into the voids 20I1 and 20I2. The two non-shaft arrangement parts (voids 20I1 and 20I2) are both arranged at the center of the roll of paper PR in the axial direction and oppose each other in the front-back direction. Of course, the voids 20I1 and 20I2 do not need to oppose each other. The size of the voids 20I1 and 20I2 may be the same as that of the void 20 shown in FIG. 6.

It should be noted that although the widths of the shaft 191*a*3 of the support roller 191I1, the shaft 191*a*3 of the support roller 191I2, the shaft 192*a*3 of the support roller 192I1, and the shaft 192*a*3 of the support roller 192I2 are all L4 in the example shown in FIG. 17, the widths may differ.

According to this embodiment, since the voids (voids 20I1 and 20I2) are formed at the front and back of the inlet 18*a*, the small-diameter roll PRs fit into the drop portion 18 can be picked up from the front and back. Accordingly, the small-diameter roll PRs can be taken out easily. If the voids 20I1 and 20I2 are arranged at the center of the roll of paper PR in the axial direction in particular, a finger will be positioned near a barycenter of the small-diameter roll PRs. Therefore, even when the small-diameter roll PRs is picked up, the small-diameter roll PRs is not tilted in the left- or right-hand direction. As a result, the small-diameter roll PRs can be taken out more easily.

The embodiments described above are mere examples, and various modifications and applications are possible.

For example, in the first to tenth embodiments, one or two support rollers is/are arranged on the rotation direction Dl side of the inlet 18*a*, and one or two support rollers is/are arranged on the opposite direction D2 side of the inlet 18*a*. However, the number of support rollers to be arranged is not limited to the examples of the first to tenth embodiments. 3 or more support rollers may be arranged on the rotation direction side of the inlet 18*a*, and 3 or more support rollers may also be arranged on the opposite direction side of the inlet 18*a*. In this case, at least one of the plurality of support rollers may be a short-width roller. In addition, a non-shaft arrangement part formed at the extension portion of the short-width roller in the axial direction may be a void into which a finger of a person can be inserted. Further, the number of roller portions to be arranged in one support roller can also be changed arbitrarily. The shape of the roller portions can also be changed arbitrarily.

Furthermore, although the outlet 21 is opened upwardly in the embodiments described above, the outlet 21 does not necessarily need to be opened upwardly. For example, the outlet 21 may be opened in a horizontal direction.

Further, although the printing unit 14 is a thermal-type printing unit in the embodiments described above, the printing unit 14 is not limited to the thermal-type printing unit. For example, the printing unit 14 may be a dot-impact-type printing unit, an inkjet-type printing unit, or an electrophotographic-type printing unit.

Further, although the printer 100 is fixed to or incorporated into the product information processing apparatus 1 in the embodiments described above, the printer 100 may be provided as an external apparatus of the product information processing apparatus 1. For example, the printer 100 may be configured to include a connection interface such as a USB (Universal Serial Bus) so as to be capable of connecting with the product information processing apparatus 1 via a communication cable such as a USB cable.

The printer 100 may also be configured to include a user interface so as to be capable of operating as a single body independent from the product information processing apparatus 1. Moreover, the printer 100 may be connected to a personal computer and operate on the basis of instructions from the personal computer.

Further, although the product information processing apparatus 1 is a POS terminal in the embodiments described above, the product information processing apparatus 1 is not limited to a POS terminal. For example, the product information processing apparatus 1 may be a simple-operation-type cash register that does not include a network connection function.

Moreover, although the printer 100 is installed in a POS terminal or a simple-operation-type cash register in the embodiments described above, an apparatus in which the printer 100 is to be installed may be other apparatuses such as an automatic vending machine.

Furthermore, although the printer 100 is assumed to be a receipt printer in the embodiments described above, the printer 100 does not necessarily need to be a receipt printer. For example, the printer 100 may be a label printer. At this time, the roll of paper PR to be stored in the printer 100 may be a roll of paper PR for labels, that is obtained by rolling a label mount. Of course, the printer 100 may be printers other than a receipt printer and a label printer.

While certain embodiments have been described, these embodiments have been presented by way of example only, and are not intended to limit the scope of the inventions. Indeed, the novel methods and systems described herein may be embodied in a variety of the other forms; furthermore, various omissions, substitutions and changes in the form the methods and systems described herein may be made without departing from the spirit of the inventions. The accompanying claims and their equivalents are intended to cover such forms or modifications as would fall within the scope and spirit of the inventions.

What is claimed is:

1. A printer that prints on paper taken out from a roll of paper, comprising:

a holder that stores the roll of paper;

a drop portion that is positioned at a bottom portion of the holder and catches, in a case where a diameter of the roll of paper stored in the holder becomes smaller than a preset diameter, the roll of paper that falls from the holder; and a plurality of support rollers that each include a shaft and rotatably support the roll of paper stored in the holder, the plurality of support rollers being arranged so that the rollers sandwich an inlet of the drop portion in a state where at least one of the plurality of support rollers is positioned on a roll-of-paper rotation direction side of the inlet and at least another one of the plurality of support rollers is positioned on a side opposite to the roll-of-paper rotation direction of the inlet, at least one of the plurality of support rollers being a short-width roller whose width in an axial direction of the shaft is shorter than a paper width of the roll of paper, and a void being provided in a non-shaft arrangement part provided at an extension portion of the short-width roller in the axial direction of the shaft.

2. The printer according to claim 1, further comprising a sensor that is provided in the drop portion and detects the roll of paper caught in the drop portion.

3. A printer that prints on paper taken out from a roll of paper, comprising:

a holder that stores the roll of paper;

a drop portion that is positioned at a bottom portion of the holder and catches, in a case where a diameter of the roll of paper stored in the holder becomes smaller than a preset diameter, the roll of paper that falls from the holder;

a progression-side support roller that includes a shaft and rotatably supports the roll of paper stored in the holder; and an opposite-side support roller that includes a shaft and rotatably supports the roll of paper stored in the holder, the progression-side support roller and the opposite-side support roller being arranged so that the rollers sandwich an inlet of the drop portion in a state where the progression-side support roller is positioned on a roll-of-paper rotation direction side of the inlet and the opposite-side support roller is positioned on a side opposite to the roll-of-paper rotation direction of the inlet, at least one of the progression-side support roller and the opposite-side support roller being a short-width roller whose width in an axial direction of the shaft is shorter than a paper width of the roll of paper, and a void being provided in a non-shaft arrangement part provided at an extension portion of the short-width roller in the axial direction of the shaft.

4. The printer according to claim 3, wherein the progression-side support roller and the opposite-side support roller are each the short-width roller, the progression-side support roller is arranged more on one side of the roller than the other in the axial direction of the shaft, and the opposite-side support roller is arranged more on a side opposite to the side on which the progression-side support roller is arranged.

5. The printer according to claim 3, wherein the progression-side support roller is a long-width roller whose width in the axial direction of the shaft is equal to or larger than the paper width, the opposite-side support roller is the short-width roller, and the void is provided at both extension portions of the opposite-side support roller in the axial direction of the shaft.

6. The printer according to claim 3, wherein the opposite-side support roller is a long-width roller whose width in the axial direction of the shaft is equal to or larger than the paper width, the progression-side support roller is the short-width roller, and the void is provided at both extension portions of the progression-side support roller in the axial direction of the shaft.

7. The printer according to claim 3, further comprising a sensor that is provided in the drop portion and detects the roll of paper caught in the drop portion.

8. A printer that prints on paper taken out from a roll of paper, comprising:

a holder that stores the roll of paper;

a drop portion that is positioned at a bottom portion of the holder and catches, in a case where a diameter of the roll of paper stored in the holder becomes smaller than a preset diameter, the roll of paper that falls from the holder;

first and second progression-side support rollers that each include a shaft and rotatably support the roll of paper stored in the holder; and first and second opposite-side support rollers that each include a shaft and rotatably support the roll of paper stored in the holder, the first and second progression-side support rollers and the first and second opposite-side support rollers being arranged so that the rollers sandwich an inlet of the drop portion in a state where the first and second progression-side support rollers are positioned on a roll-of-paper rotation direction side of the inlet and the first and second opposite-side support rollers are positioned on a side opposite to the roll-of-paper rotation direction of the inlet, the first and second progression-side support rollers being aligned such that the axial directions of the shafts thereof coincide, a void being provided in a first non-shaft arrangement part formed between the first and second progression-side support rollers, and the first and second opposite-side support rollers being aligned such that the axial directions of the shafts thereof coincide, a void being provided in a second non-shaft arrangement part formed between the first and second opposite-side support rollers.

9. The printer according to claim 8, wherein the first and second progression-side support rollers and the first and second opposite-side support rollers are arranged such that the first non-shaft arrangement part and the second non-shaft arrangement part oppose each other.

10. The printer according to claim 9, wherein the first and second progression-side support rollers are arranged such that the first non-shaft arrangement part is positioned at a center of the roll of paper in an axial direction, and the first and second opposite-side support rollers are arranged such that the second non-shaft arrangement part is positioned at the center of the roll of paper in the axial direction.

11. The printer according to claim 8, further comprising a sensor that is provided in the drop portion and detects the roll of paper caught in the drop portion.

* * * * *